US011422494B2

(12) United States Patent
Sakai et al.

(10) Patent No.: US 11,422,494 B2
(45) Date of Patent: Aug. 23, 2022

(54) FIXING DEVICE HAVING HEATER HOLDING MEMBER RESTRICTING MOVEMENT OF BELT HOLDING MEMBER, AND IMAGE FORMING APPARATUS INCLUDING SAME

(71) Applicant: KYOCERA Document Solutions Inc., Osaka (JP)

(72) Inventors: Yuhiro Sakai, Osaka (JP); Masakazu Uehara, Osaka (JP); Tomohiro Watatani, Osaka (JP); Fumito Nakamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/325,016

(22) Filed: May 19, 2021

(65) Prior Publication Data

US 2021/0364961 A1 Nov. 25, 2021

(30) Foreign Application Priority Data

May 20, 2020 (JP) ..... JP2020-088140

(51) Int. Cl.
*G03G 15/20* (2006.01)

(52) U.S. Cl.
CPC ..... *G03G 15/2053* (2013.01); *G03G 15/2064* (2013.01); *G03G 2215/2038* (2013.01)

(58) Field of Classification Search
USPC ..... 399/328
See application file for complete search history.

(56) References Cited

U.S. PATENT DOCUMENTS 7,235,761 B1 * 6/2007 Maul ..... G03G 15/2064 219/216
9,031,447 B2 * 5/2015 Tanaka ..... G03G 15/2053 399/122
2014/0186078 A1 * 7/2014 Imaizumi ..... G03G 15/2017 399/329
2018/0203390 A1 * 7/2018 Honke ..... G03G 15/2053

FOREIGN PATENT DOCUMENTS

JP 4599189 B2 12/2010

* cited by examiner

*Primary Examiner* — Quana Grainger
(74) *Attorney, Agent, or Firm* — Alleman Hall Creasman & Tuttle LLP

(57) ABSTRACT

A fixing device includes a fixing belt, a heater holding member, and a belt holding member. The fixing belt fixes a toner image to a sheet by heating the sheet. The heater holding member guides the fixing belt such that the fixing belt can peripherally rotate. The heater holding member holds a heater that heats the fixing belt. The belt holding member is fixed in position with respect to a conveyance path of the sheet and holds an end portion of the fixing belt in a rotation axis direction of the fixing belt such that the fixing belt can peripherally rotate. The belt holding member includes an engaging portion. The heater holding member includes an engaged portion that is engaged with the engaging portion to restrict a movement of the belt holding member with respect to the heater holding member.

7 Claims, 8 Drawing Sheets

FIXING DEVICE HAVING HEATER HOLDING MEMBER RESTRICTING MOVEMENT OF BELT HOLDING MEMBER, AND IMAGE FORMING APPARATUS INCLUDING SAME

INCORPORATION BY REFERENCE

This application is based upon and claims the benefit of priority from the corresponding Japanese Patent Application No. 2020-088140 filed on May 20, 2020, the entire contents of which are incorporated herein by reference.

BACKGROUND

The present disclosure relates to a fixing device and an image forming apparatus.

There is known a fixing device that includes a support member supporting a heater; and a tubular film.

SUMMARY

A fixing device according to an aspect of the present disclosure includes a fixing belt, a heater holding member, and a belt holding member. The fixing belt is configured to heat a sheet. The heater holding member guides the fixing belt such that the fixing belt can peripherally rotate. The heater holding member holds a heater that heats the fixing belt. The belt holding member is fixed in position with respect to a conveyance path of the sheet and holds an end portion of the fixing belt in a rotation axis direction of the fixing belt such that the fixing belt can peripherally rotate. The belt holding member includes an engaging portion. The heater holding member includes an engaged portion that is engaged with the engaging portion to restrict a movement of the belt holding member with respect to the heater holding member.

An image forming apparatus according to another aspect of the present disclosure includes the fixing device described above and an image forming portion. The image forming portion is configured to form an image on a sheet.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Embodiment 1

Figure 1:
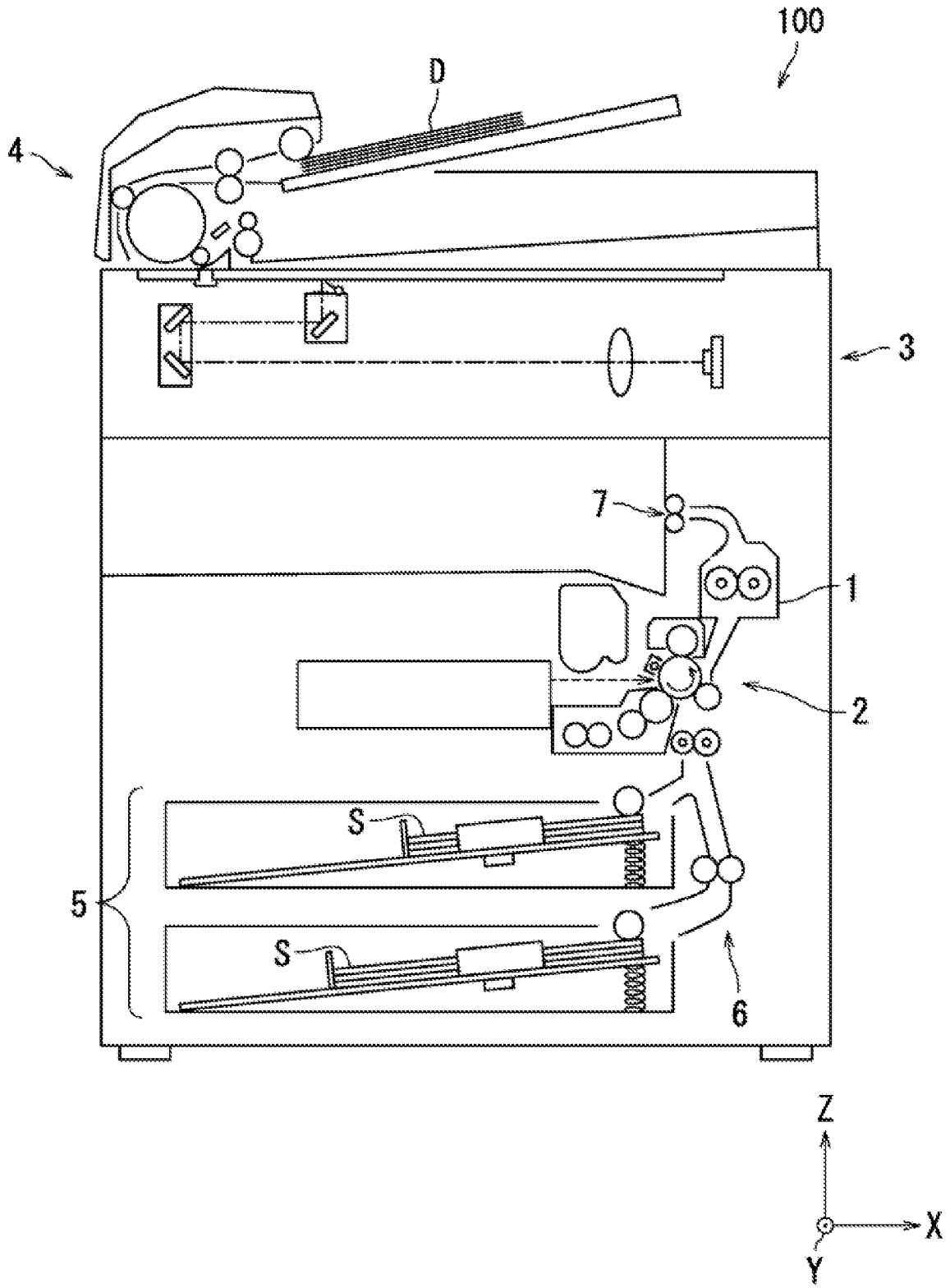
FIG. 1 is a diagram showing an image forming apparatus including a fixing device according to Embodiment 1 of the present disclosure.

The following describes Embodiment 1 of the present disclosure with reference to the accompanying drawings. It is noted that in the drawings, same or similar portions are assigned the same reference signs, and the explanation is not repeated. In addition, in Embodiment 1, X-axis, Y-axis, and Z-axis that are perpendicular to each other are shown in the drawings. The Z-axis is parallel to a vertical plane, and the X-axis and the Y-axis are parallel to a horizontal plane.

The following describes an image forming apparatus 100 according to Embodiment 1 of the present disclosure with reference to FIG. 1. FIG. 1 shows the image forming apparatus 100 according to Embodiment 1. The image forming apparatus 100 is, for example, a copier, a facsimile, or a multifunction peripheral having functions of these. In Embodiment 1, the image forming apparatus 100 is a monochrome multifunction peripheral.

As shown in FIG. 1, the image forming apparatus 100 includes a fixing device 1, an image forming portion 2, a reading portion 3, a document sheet conveyance portion 4, a sheet feed portion 5, a conveyance portion 6, and a discharge portion 7.

The sheet feed portion 5 feeds a sheet S. The sheet feed portion 5 may include a tray and a pickup roller. The sheet S is stacked on the tray. The pickup roller picks up the sheet S on the tray and feeds the sheet S. The sheet S is an example of a recording medium of the present disclosure.

The conveyance portion 6 conveys the sheet S fed from the sheet feed portion 5. The conveyance portion 6 may include a conveyance roller and a registration roller in a conveyance path. A plurality of conveyance rollers may be disposed in the conveyance path. The conveyance rollers convey the sheet S.

The registration roller adjusts a timing at which the sheet S is conveyed to the image forming portion 2. The conveyance portion 6 conveys the sheet S from the sheet feed portion 5 to the discharge portion 7 via the image forming portion 2 and the fixing device 1.

The image forming portion 2 forms a toner image (not shown) on the sheet S by an electrophotographic method based on image data. The image data represents, for example, an image of a document sheet D. The image forming portion 2 includes, for example, a photoconductor drum, a charging device, an exposure device, a developing device, a replenishing device, a transfer roller, a cleaning device, and an electricity removing device.

The fixing device 1 fixes the toner image to the sheet S by heating and pressing the toner image.

The discharge portion 7 discharges the sheet S to outside of a housing of the image forming apparatus 100. The discharge portion 7 may include a discharge roller and a discharge tray. The discharge roller discharges the sheet S that has been conveyed from the fixing device 1 by the conveyance roller, onto the discharge tray. The discharged sheet S is stacked on the discharge tray.

The document sheet conveyance portion 4 conveys the document sheet D. The document sheet conveyance portion 4 is, for example, an ADF (Auto Document Feeder).

The reading portion 3 reads an image of the document sheet D conveyed by the document sheet conveyance portion 4. The reading portion 3 generates image data from the read image. The reading portion 3 may be, for example, a scanner adopting a CIS (Contact Image Sensor) method or a CCD (Charge Coupled Devices) method.

Figure 2:
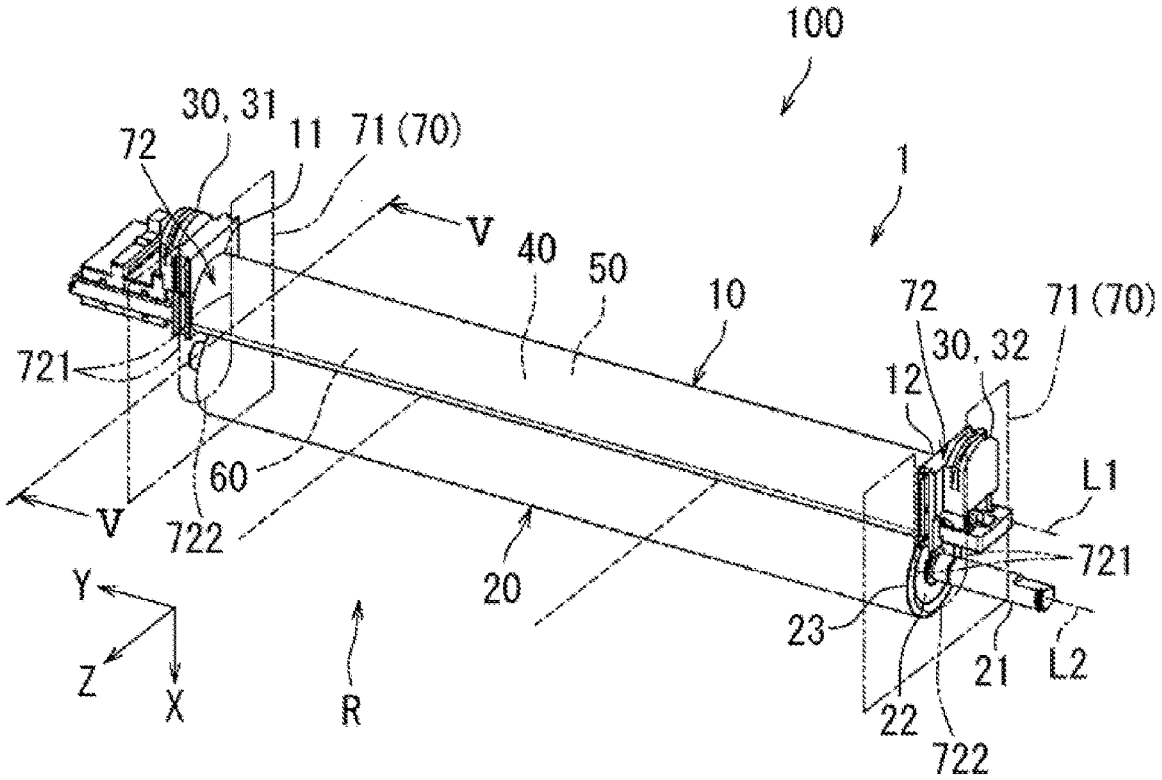
FIG. 2 is a perspective diagram showing a main part of the fixing device according to Embodiment 1 of the present disclosure.
Figure 3:
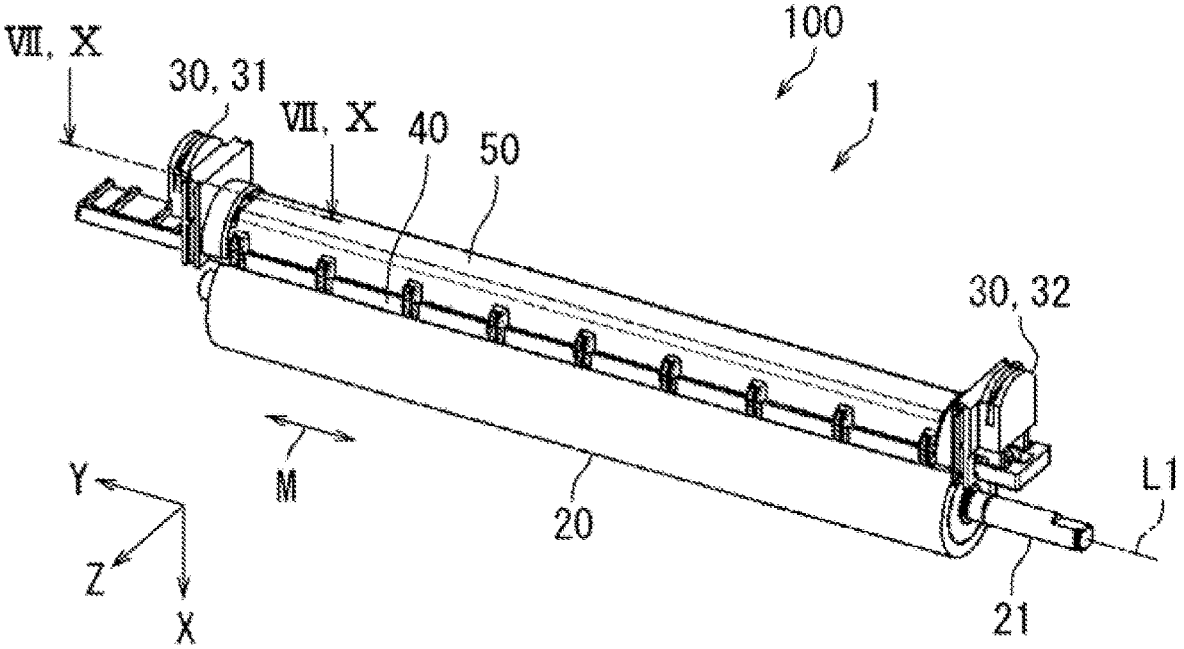
FIG. 3 is a perspective diagram showing the main part of the fixing device according to Embodiment 1 of the present disclosure excluding a fixing belt.

Next, the following describes a detailed configuration of the fixing device 1 according to Embodiment 1 with reference to FIG. 2 and FIG. 3. FIG. 2 is a perspective diagram showing a main part of the fixing device 1 according to Embodiment 1. FIG. 3 is a perspective diagram of the main part of the fixing device 1 according to Embodiment 1 excluding a fixing belt 10.

Figure 4A:
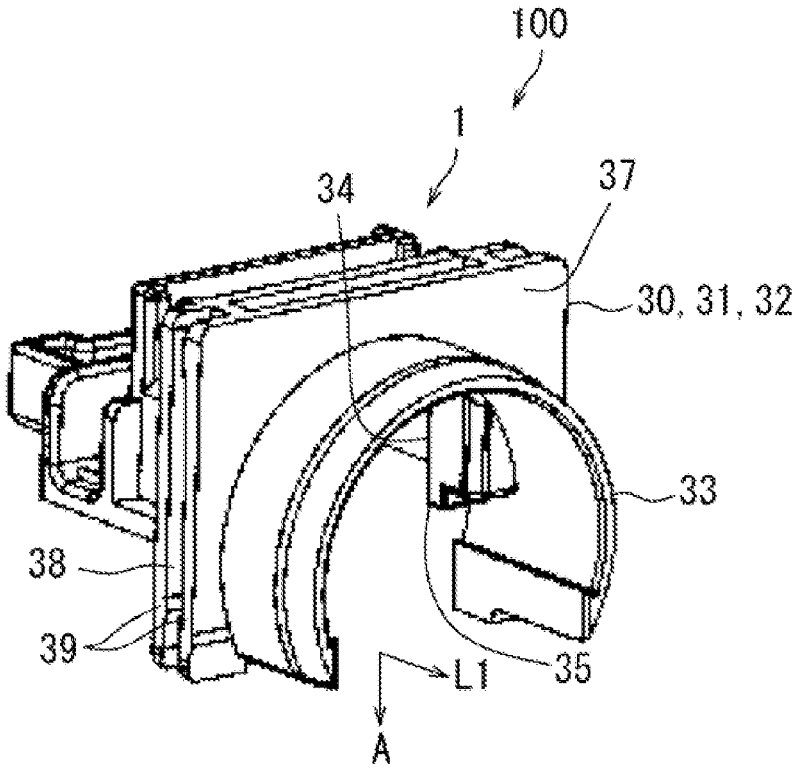
FIG. 4A and FIG. 4B are perspective diagrams of a belt holding member provided in the fixing device according to Embodiment 1 of the present disclosure.
Figure 4B:
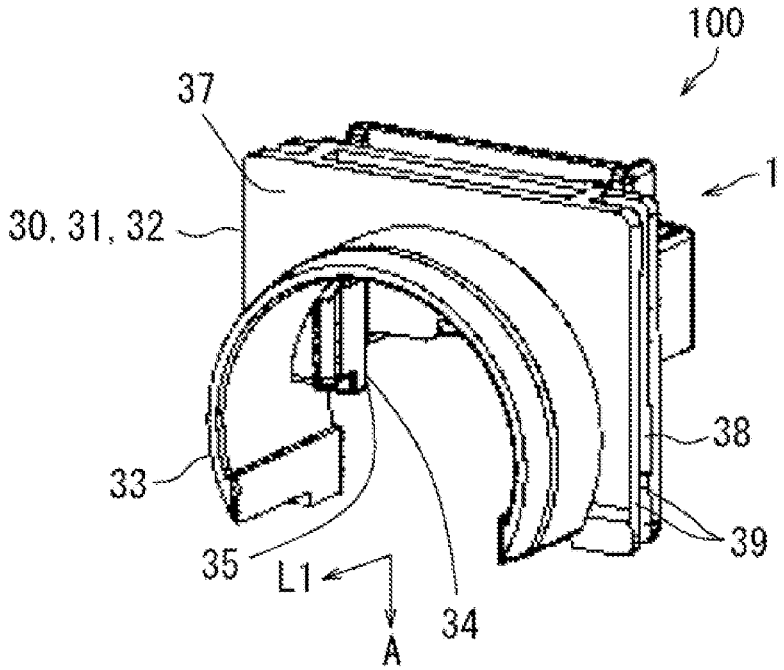
Figure 5:
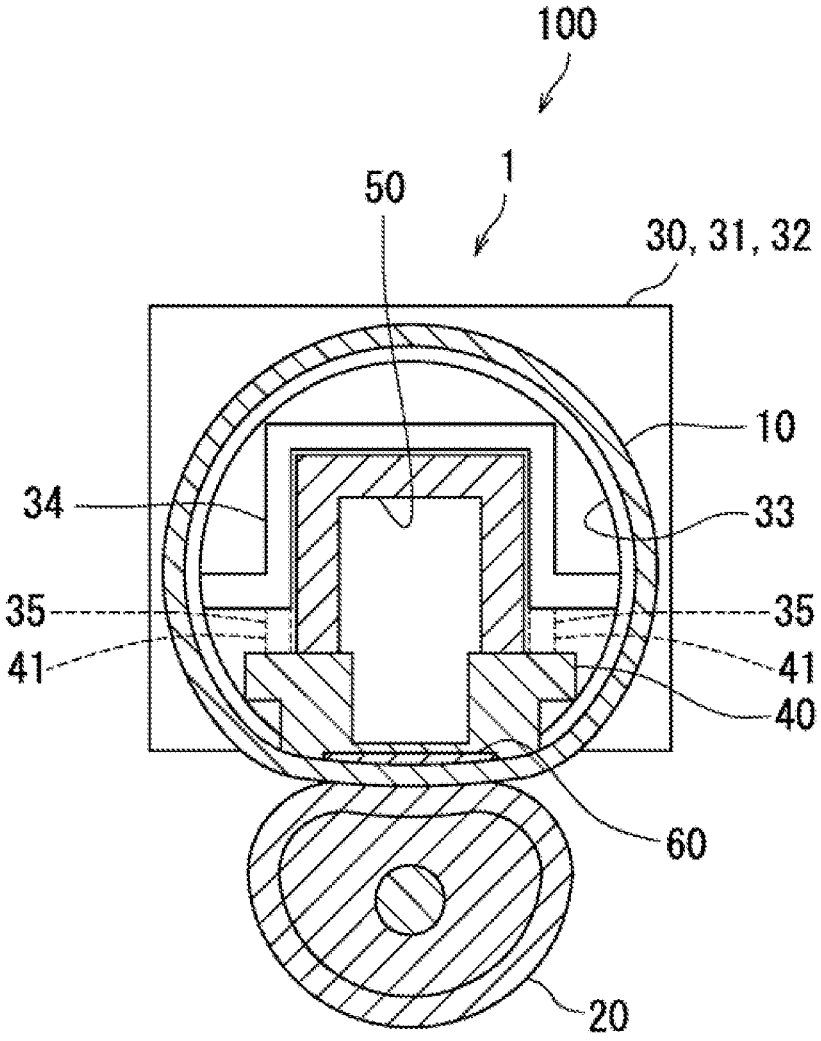
FIG. 5 is a cross-section diagram of the main part of the fixing device taken along a line V-V of FIG. 2.
Figure 6:
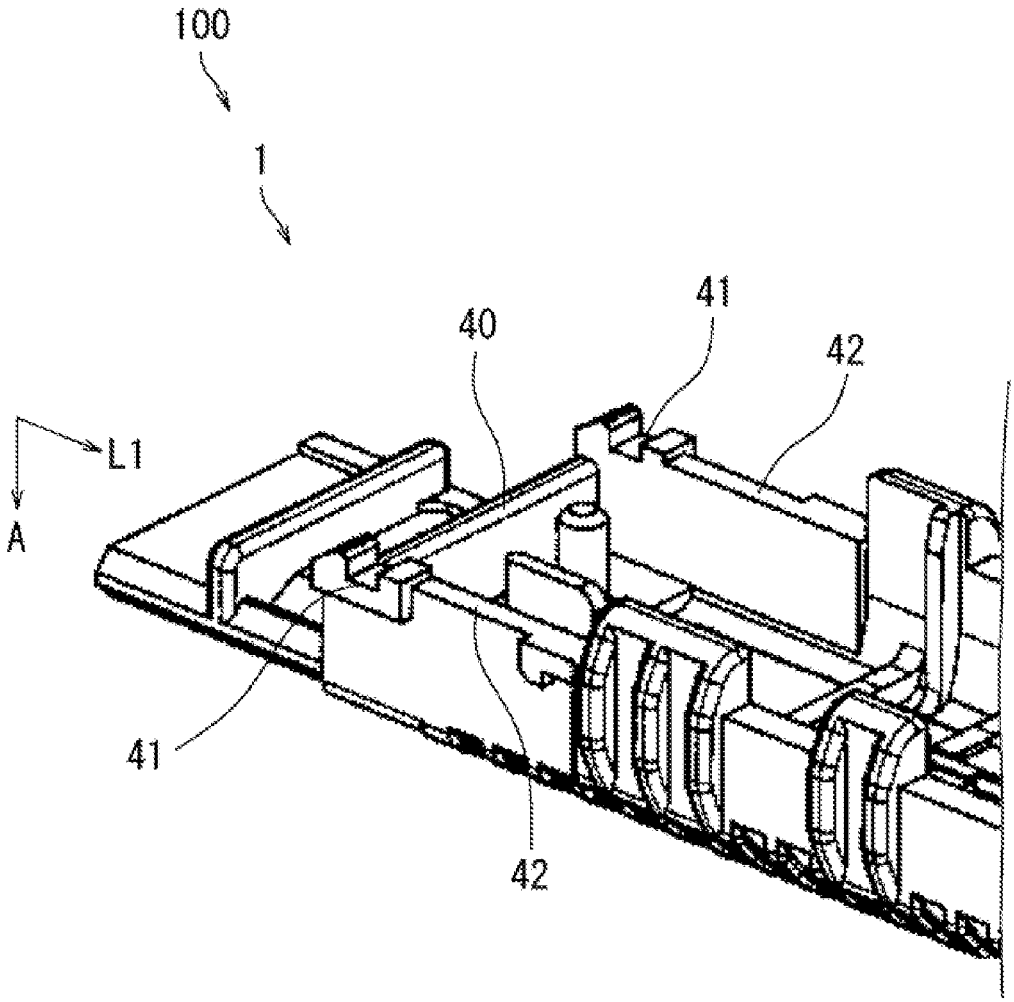
FIG. 6 is a perspective diagram of an end portion of a heater holding member provided in the fixing device according to Embodiment 1 of the present disclosure.
Figure 7A:
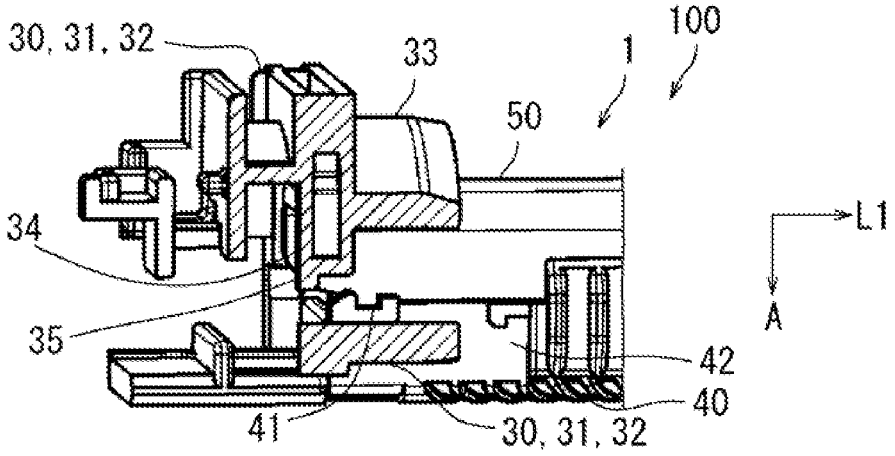
FIG. 7A to FIG. 7C are cross-section diagrams of the main part of the fixing device taken along a line VII-VII of FIG. 3.
Figure 7B:
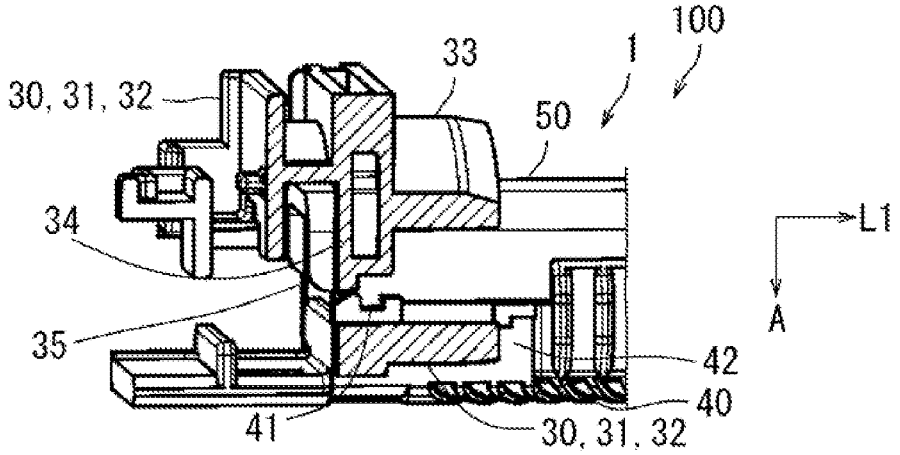
Figure 7C:
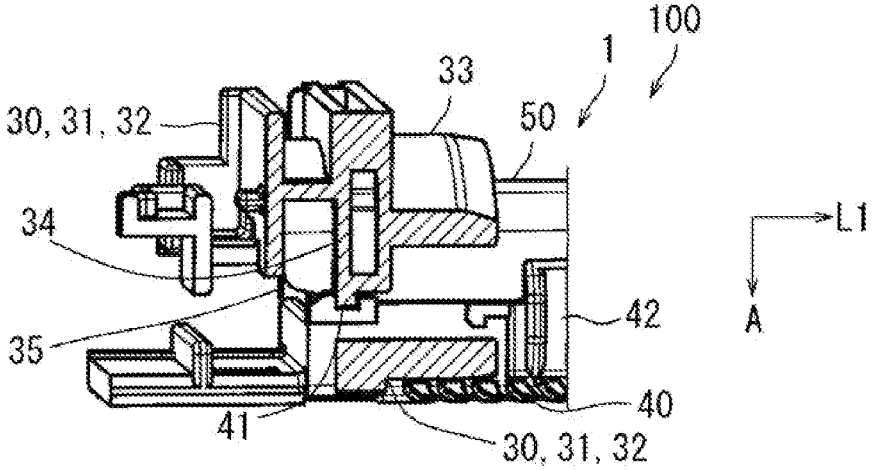

FIG. 4A and FIG. 4B are perspective diagrams of a belt holding member 30 provided in the fixing device 1 according to Embodiment 1. FIG. 5 is a cross-section diagram taken along a line V-V of FIG. 2. FIG. 6 is a perspective diagram of an end portion of a heater holding member 40 provided in the fixing device 1 according to Embodiment 1. FIG. 7A to FIG. 7C are cross-section diagrams taken along a line VII-VII of FIG. 3.

In Embodiment 1, the fixing device 1 includes the fixing belt 10, the heater holding member 40, the belt holding member 30, and a pressure applying member 20. The fixing belt 10 fixes a toner image to the sheet S by heating the sheet S.

The heater holding member 40 guides the fixing belt 10 such that the fixing belt 10 can peripherally rotate, and the heater holding member 40 holds a heater 60 that heats the fixing belt 10. The belt holding member 30 is supported by a fixing frame 70 that is fastened to a main-body frame of the image forming apparatus 100.

The belt holding member 30 is fixed in position in a width direction of a conveyance path of the sheet S and holds the fixing belt 10 such that the fixing belt 10 can peripherally rotate. The belt holding member 30 holds an end portion 11 of the fixing belt 10 in a rotation axis direction thereof. A direction along the first rotation axis line L1 shown in FIG. 2 and FIG. 3 is the rotation axis direction of the fixing belt 10. The width direction of the conveyance path is a direction perpendicular to a conveyance direction of the sheet S and is along the conveyance path.

As shown in FIG. 2, the fixing frame 70 includes a pair of side plates 71 that are disposed to face each other at opposite ends of the fixing frame 70 in the direction along the first rotation axis line L1. The side plates 71 are sheet metal members. A support portion 72 is formed in each of the side plates 71, wherein the support portion 72 is opened in a shape of the letter U extending from the fixing belt 10 side toward the pressure applying member 20.

The support portion 72 includes a pair of straight edge portions 721 and an arc edge portion 722. The pair of straight edge portions 721 are straight edge portions extending straight in parallel to each other. The arc edge portion 722 is an arc-shaped edge portion that is connected to the straight edge portions 721. The pressure applying member 20 is rotationally supported by the arc edge portion 722 via a bearing member (not shown).

As shown in FIG. 4A and FIG. 4B, the belt holding member 30 includes a base portion 37 that appears like a rectangular flange. Guide grooves 38 are respectively formed on two side surfaces of the base portion 37, the guide grooves 38 extending straight in parallel to each other. A pair of side walls 39 of each guide groove 38 are opposed to each other through a space that is slightly wider than the plate thickness of the side plates 71 of the fixing frame 70.

The belt holding member 30 is slid while the pair of side walls 39 of each guide groove 38 hold, in the plate thickness direction, the straight edge portion 721 of the side plate 71, thereby the belt holding member 30 is attached to the support portion 72 of the side plate 71. The belt holding member 30 is configured to slide in a direction to approach and separate with respect to the pressure applying member 20. The belt holding member 30 is fixed in position in the rotation axis direction of the fixing belt 10.

The belt holding member 30 further includes an engaging portion 35. The heater holding member 40 further includes an engaged portion 41. The engaged portion 41 is engaged with the engaging portion 35 and thereby restricts the movement of the belt holding member 30 with respect to the heater holding member 40.

In addition, in Embodiment 1, the engaging portion 35 is a projection portion 35, and the engaged portion 41 is a recessed portion 41.

In addition, in Embodiment 1, the projection portion 35 projects in a direction perpendicular to the rotation axis of the fixing belt 10. The recessed portion 41 is recessed in the direction perpendicular to the rotation axis of the fixing belt 10 such that the projection portion 35 is locked to the recessed portion 41. The fixing belt 10 is disposed such that the rotation axis thereof is along the first rotation axis line L1.

In addition, in Embodiment 1, the fixing device 1 further includes a stay sheet-metal 50 that reinforces the heater holding member 40. The belt holding member 30 further includes a stay sheet-metal holding portion 34. The stay sheet-metal holding portion 34 holds the stay sheet-metal 50 such that the stay sheet-metal 50 is fastened to the heater holding member 40. The engaging portion 35 is disposed in the stay sheet-metal holding portion 34.

In the following, a detailed description is given of the fixing device 1 according to Embodiment 1 with reference to FIG. 1 to FIG. 7. As shown in FIG. 2 and FIG. 3, the fixing device 1 includes the fixing belt 10, the pressure applying member 20, the heater holding member 40, the belt holding member 30, and the stay sheet-metal 50.

A toner image is formed on the sheet S by the image forming portion 2 shown in FIG. 1, and the sheet S is conveyed to the fixing device 1. As shown in FIG. 2, the fixing belt 10 fixes the toner image to the sheet S by heating the sheet S conveyed to the fixing device 1.

The fixing belt 10 is endless. The fixing belt 10 is approximately cylindrical in shape. The fixing belt 10 is flexible. The fixing belt 10 is configured to peripherally rotate around the first rotation axis line L1. The fixing belt 10 extends along the first rotation axis line L1.

The fixing belt 10 includes a first end portion 11 and a second end portion 12. The first end portion 11 and the second end portion 12 are opposite ends of the fixing belt 10 in the direction along the first rotation axis line L1. In the following description, the direction along the first rotation axis line L1 may be denoted as "rotation axis direction", "rotation axis direction of the fixing belt 10", or "width direction of the fixing belt 10".

The fixing belt 10 further includes a plurality of layers. The fixing belt 10 includes, for example, a polyimide layer and a release layer. The release layer is formed on the outer peripheral surface of the polyimide layer. The release layer is, for example, a heat-resistant film made of fluororesin.

The pressure applying member 20 comes in close contact with the fixing belt 10 with pressure while driven to rotate, thereby causing the fixing belt 10 to be driven to rotate. The pressure applying member 20 is approximately columnar, and is disposed to face the fixing belt 10. The pressure applying member 20 is, for example, a force applying roller.

The pressure applying member 20 is freely rotatable around a second rotation axis line L2 as its axial center. The pressure applying member 20 is formed to extend along the second rotation axis line L2. It is noted that the second rotation axis line L2 and the first rotation axis line L1 are approximately parallel to each other.

When the pressure applying member 20 comes in close contact with the fixing belt 10 with pressure, the heater 60 held by the heater holding member 40 comes in close contact with the fixing belt 10 with pressure (see FIG. 5). As a result, the fixing belt 10 is heated by the heater 60.

The pressure applying member 20 includes a columnar metal core 21, a cylindrical elastic layer 22, and a release layer 23. The elastic layer 22 is formed on the metal core 21. The release layer 23 is formed to cover the surface of the elastic layer 22.

The metal core 21 is held by the support portion 72 of the fixing frame 70 via a bearing member (not shown). The metal core 21 is freely rotatable around the second rotation axis line L2 as its axial center. The metal core 21 is formed from, for example, stainless or aluminum. The elastic layer 22 is elastic, and is formed from, for example, silicone rubber. The release layer 23 is formed from, for example, fluororesin.

The heater holding member 40 holds the heater 60 that heats the fixing belt 10. The heater 60 is attached to the heater holding member 40 in such a way as to face an inner peripheral surface of the fixing belt 10. The belt holding member 30 is configured to be attached to the heater holding member 40.

The heater 60 is connected with a power supply (not shown) and is configured to generate heat. The heater 60 heats the fixing belt 10. The heater 60 is formed to extend along the first rotation axis line L1. The heater 60 is, for example, a surface heater or an elongated thin-plate heater. The heater 60 is, for example, a ceramic heater. The ceramic heater includes a ceramic substrate and a heating resistor. The heater 60 is, for example, 1 mm thick. The heater 60 receives a pressure from the pressure applying member 20 via the fixing belt 10.

As shown in FIG. 2, the belt holding member 30 holds the fixing belt 10 such that the fixing belt 10 can peripherally rotate. The belt holding member 30 is fixed in position with respect to a conveyance path R of the sheet S. That is, the belt holding member 30 is attached to a sheet metal (not shown) provided in the fixing device 1. As a result, the relative position of the belt holding member 30 in the width direction with respect to the conveyance path R of the sheet S does not change and the belt holding member 30 is fixed in position.

This is related to a configuration where the heater holding member 40 is disposed at a constant position with respect to the width direction of the conveyance path R of the sheet S. That is, the belt holding member 30 is fixed in position in the width direction with respect to the conveyance path R of the sheet S, and the movement of the heater holding member 40 with respect to the belt holding member 30 is restricted.

The belt holding member 30 holds the fixing belt 10 such that the fixing belt 10 can peripherally rotate. The belt holding member 30 holds a first end portion 11 and a second end portion 12 that are opposite ends of the fixing belt 10 in the rotation axis direction thereof.

As shown in FIG. 4A and FIG. 4B, the belt holding member 30 includes a fixing belt holding portion 33. As shown in FIG. 5, the fixing belt holding portion 33 guides the fixing belt 10 such that the fixing belt 10 can peripherally rotate.

That is, the first end portion 11 of the fixing belt 10 is fitted in the fixing belt holding portion 33 of the belt holding member 30, and the second end portion 12 is fitted in the fixing belt holding portion 33 of the belt holding member 30. This allows the fixing belt 10 to peripherally rotate with respect to the belt holding member 30.

The belt holding member 30 further includes the engaging portion 35. As shown in FIG. 6, the heater holding member 40 further includes the engaged portion 41. The engaged portion 41 is engaged with the engaging portion 35 and thereby restricts the movement of the belt holding member 30 with respect to the heater holding member 40.

With the configuration where the engaging portion 35 of the belt holding member 30 is engaged with the engaged portion 41 of the heater holding member 40, the heater holding member 40 is restricted to a constant position with respect to the width direction of the conveyance path R of the sheet S. That is, the belt holding member 30 is fixed in position with respect to the width direction of the conveyance path R of the sheet S, and the movement of the heater holding member 40 with respect to the belt holding member 30 is restricted.

In addition, the belt holding member 30 includes a first belt holding member 31 and a second belt holding member 32. The first belt holding member 31 holds the first end portion 11 of the fixing belt 10 such that the first end portion 11 can peripherally rotate. The second belt holding member 32 holds the second end portion 12 of the fixing belt 10 such that the second end portion 12 can peripherally rotate. The belt holding member 30 may be either the first belt holding member 31 or the second belt holding member 32.

As shown in FIG. 3, FIG. 5, and FIG. 7A to FIG. 7C, the stay sheet-metal 50 reinforces the heater holding member 40. The stay sheet-metal 50 is, for example, an elongated metal stay member. As shown in FIG. 3, the stay sheet-metal 50 extends along the first rotation axis line L1. The stay sheet-metal 50 may be formed in the shape of the letter U or V.

According to the present embodiment, the belt holding member 30 is fixed in position with respect to the conveyance path R of the sheet S, and the movement of the heater holding member 40 with respect to the belt holding member 30 is restricted. As a result, it is possible to stabilize the positional relationship between the heater 60 and the sheet S.

It is noted that if there is no structure that positions the heater holding member 40 with respect to the belt holding member 30, the position of the sheet S with respect to the heater 60 is easy to become unstable.

Next, as shown in FIG. 4A and FIG. 4B, the engaging portion 35 may be the projection portion 35. The projection portion 35 projects in a direction A that is perpendicular to the rotation axis of the fixing belt 10 (the first rotation axis line L1).

As shown in FIG. 6, the engaged portion 41 may be the recessed portion 41. The recessed portion 41 is recessed in the direction A perpendicular to the rotation axis of the fixing belt 10 such that the projection portion 35 is locked to the recessed portion 41.

The belt holding member 30 further includes the stay sheet-metal holding portion 34. The stay sheet-metal holding portion 34 holds the stay sheet-metal 50 such that the stay sheet-metal 50 is fastened to the heater holding member 40. The engaging portion 35 is disposed in the stay sheet-metal holding portion 34.

Specifically, as shown in FIG. 4A, FIG. 4B, and FIG. 5, the belt holding member 30 includes the fixing belt holding portion 33. The stay sheet-metal 50 is configured to be inserted, in a removable manner, in the belt holding member 30 from the fixing belt holding portion 33 in a state where the stay sheet-metal 50 is set to the heater holding member 40.

The heater holding member 40 with the stay sheet-metal 50 set thereto is inserted in the belt holding member 30 from the fixing belt holding portion 33. This allows the belt holding member 30 to hold the heater holding member 40 and the stay sheet-metal holding portion 34 to hold the stay sheet-metal 50.

More specifically, as shown in FIG. 7A, the heater holding member 40 with the stay sheet-metal 50 set thereto is inserted in the first belt holding member 31 toward the negative side of the direction along the first rotation axis line L1. At this time, the stay sheet-metal holding portion 34 holds the stay sheet-metal 50. FIG. 7A shows a state where the projection portion 35 of the stay sheet-metal holding portion 34 has not been engaged with the recessed portion 41 of the heater holding member 40.

Furthermore, as shown in FIG. 7B, the heater holding member 40 with the stay sheet-metal 50 set thereto is inserted in the first belt holding member 31 toward the negative side of the direction along the first rotation axis line L1. As shown in FIG. 7C, this allows the projection portion 35 of the stay sheet-metal holding portion 34 to move in the direction A to be engaged with the recessed portion 41 of the heater holding member 40.

According to the present embodiment, the projection portion 35 of the belt holding member 30 is locked to the recessed portion 41 of the heater holding member 40. This makes it difficult for the belt holding member 30 to be released from the heater holding member 40. As a result, the positional relationship between the heater 60 and the width direction of the sheet S is further stabilized.

In addition, according to the present embodiment, the projection portion 35 of the belt holding member 30 moves in the direction A perpendicular to the first rotation axis line L1 of the fixing belt 10, and is locked to the recessed portion 41 of the heater holding member 40. As a result, the belt holding member 30 is suitably restricted from moving with respect to the heater holding member 40 in the direction along the first rotation axis line L1 of the fixing belt 10. As a result, it is difficult for the belt holding member 30 to be released from the heater holding member 40.

In addition, according to the present embodiment, the belt holding member 30 is further configured to fix the stay sheet-metal 50 to the heater holding member 40.

Embodiment 2

Next, the following describes the fixing device 1 according to Embodiment 2 with reference to FIG. 1 to FIG. 3 and FIG. 5, as well as FIG. 8 to FIG. 10C.

Figure 8:
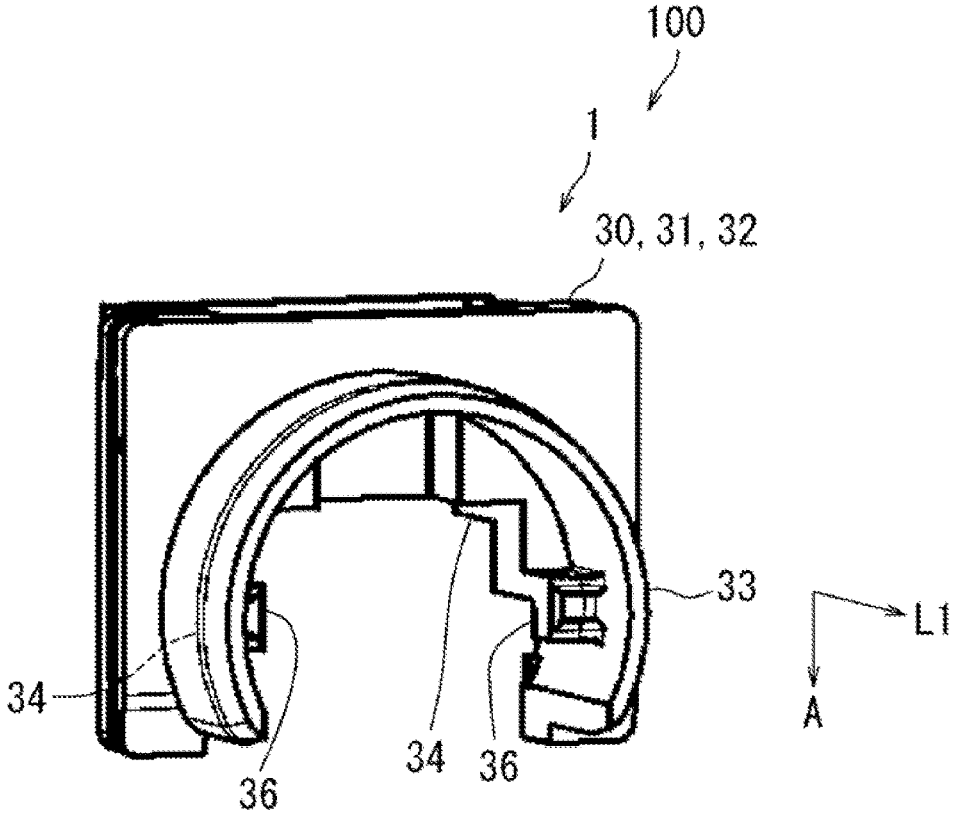
FIG. 8 is a perspective diagram of a belt holding member provided in the fixing device according to Embodiment 2 of the present disclosure.
Figure 9:
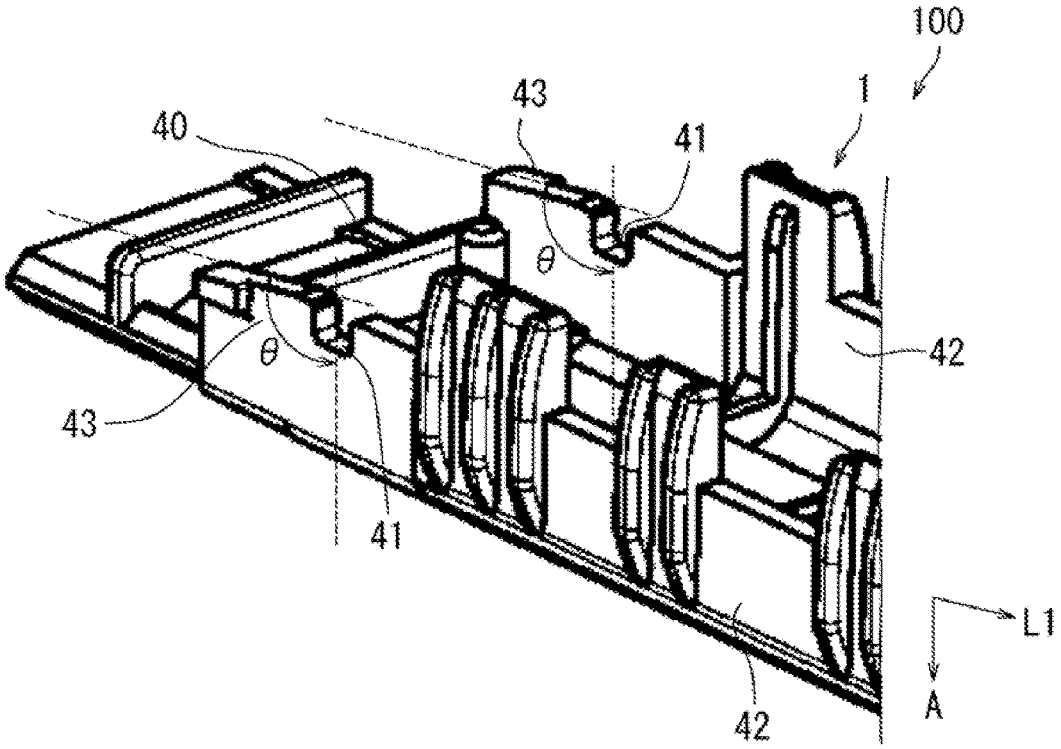
FIG. 9 is a perspective diagram of an end portion of a heater holding member provided in the fixing device according to Embodiment 2 of the present disclosure.
Figure 10A:
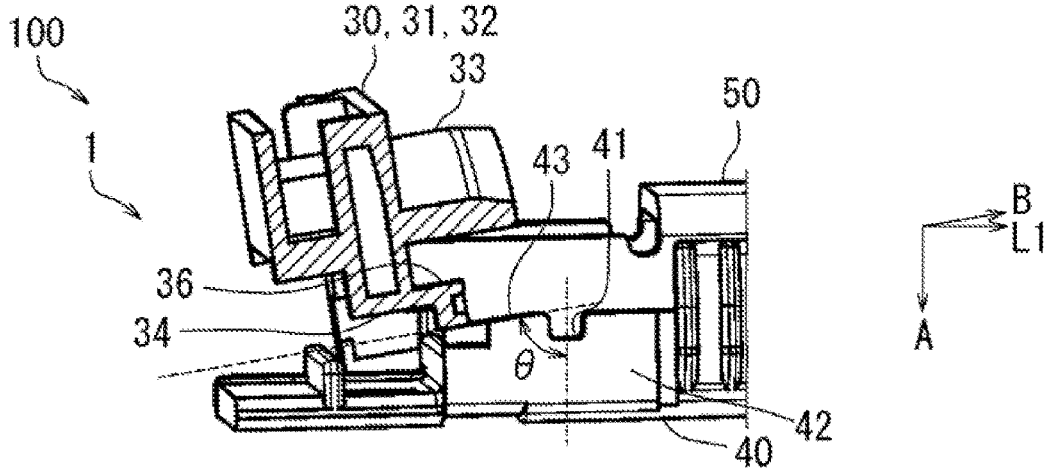
FIG. 10A to FIG. 10C are cross-section diagrams of the main part of the fixing device taken along a line X-X of FIG. 3.
Figure 10B:
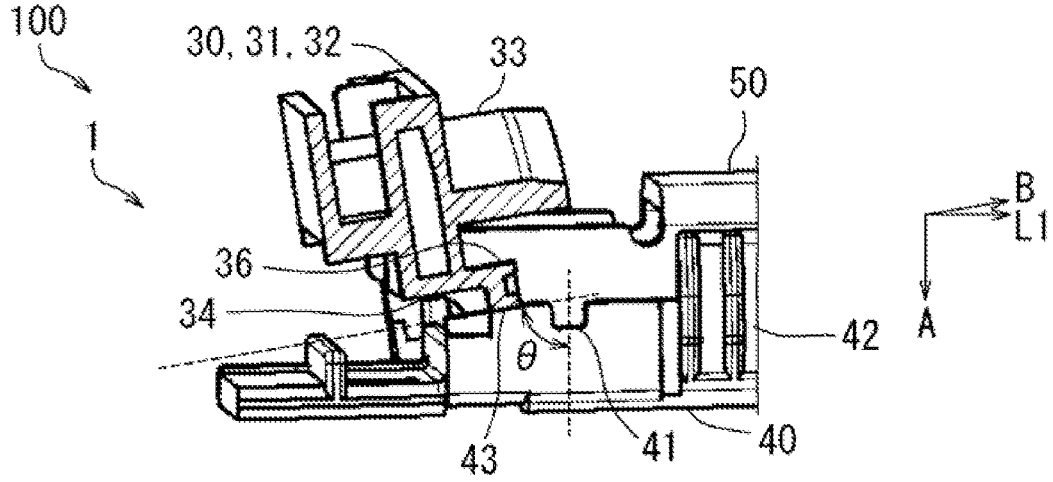
Figure 10C:
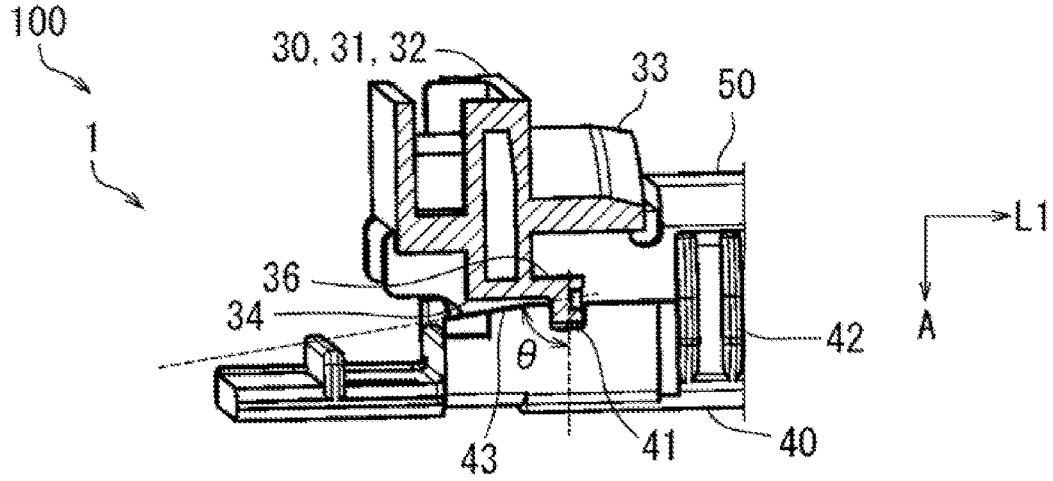

FIG. 8 is a perspective diagram of the belt holding member 30 provided in the fixing device 1 according to Embodiment 2. FIG. 9 is a perspective diagram of an end portion of the heater holding member 40 provided in the fixing device 1 according to Embodiment 2. FIG. 10A to FIG. 10C are cross-section diagrams taken along a line X-X of FIG. 3.

In Embodiment 2, the belt holding member 30 includes a hook portion 36 that performs the function of the engaging portion 35. The hook portion 36 extends in the direction along the first rotation axis line L1 of the fixing belt 10 and bends in the direction A perpendicular to the first rotation axis line L1.

Furthermore, in Embodiment 2, the heater holding member 40 includes a guide portion 43 that guides the hook portion 36 to the recessed portion 41.

In addition, in Embodiment 2, the guide portion 43 is inclined at an acute angle θ with respect to the direction A perpendicular to the first rotation axis line L1 of the fixing belt 10.

In the following, a detailed description is given of the fixing device 1 according to Embodiment 2 with reference to mainly FIG. 8 to FIG. 10C.

The belt holding member 30 includes the hook portion 36 instead of the engaging portion 35. Specifically, the belt holding member 30 includes the stay sheet-metal holding portion 34, and the stay sheet-metal holding portion 34 includes the hook portion 36.

As one example, the hook portion 36 may extend from the stay sheet-metal holding portion 34 in the positive direction of the first rotation axis line L1 of the fixing belt 10, and bend in the direction A perpendicular to the first rotation axis line L1. In addition, the hook portion 36 may extend from the stay sheet-metal holding portion 34 in the negative direction of the first rotation axis line L1 of the fixing belt 10, and bend in the direction A perpendicular to the first rotation axis line L1.

Next, as shown in FIG. 9, the heater holding member 40 further includes the guide portion 43 that guides the hook portion 36 to the engaged portion 41. More specifically, the heater holding member 40 further includes the inclined guide portion 43 that guides the hook portion 36 to the recessed portion 41.

When the belt holding member 30 is inserted or removed in/from the heater holding member 40 with the stay sheet-metal 50 set thereto, the inclined guide portion 43 guides the insertion/removal operation of the hook portion 36 of the belt holding member 30. The upper surface of the inclined guide portion 43 slides on the lower surface of the hook portion 36 in the negative direction of the first rotation axis line L1. Thereafter, the hook portion 36 is locked to the recessed portion 41.

Alternatively, when the heater holding member 40 with the stay sheet-metal 50 set thereto is inserted or removed in/from the belt holding member 30, the inclined guide portion 43 guides the insertion/removal operation of the hook portion 36 of the belt holding member 30. The lower surface of the hook portion 36 slides on the upper surface of the inclined guide portion 43 in the positive direction of the first rotation axis line L1. Thereafter, the hook portion 36 is locked to the recessed portion 41.

In addition, as shown in FIG. 9, the inclined guide portion 43 is inclined at an acute angle θ with respect to the direction A perpendicular to the first rotation axis line L1 of the fixing belt 10.

The following describes, with reference to FIG. 10A to FIG. 10C, an assembly procedure for the belt holding member 30 and the heater holding member 40 with the stay sheet-metal 50 set thereto.

FIG. 10A to FIG. 10C show a manner in which the belt holding member 30 is attached to the heater holding member 40 with the stay sheet-metal 50 set thereto. The manner is also applied when the heater holding member 40 with the stay sheet-metal 50 set thereto is attached to the belt holding member 30.

As shown in FIG. 10A, the belt holding member 30 is attached to the heater holding member 40 with the stay sheet-metal 50 set thereto. At this time, the belt holding member 30 is inclined from the positive direction of the first rotation axis line L1 toward a direction B.

The direction B is inclined at an angle of (90°-θ) with respect to the positive direction of the first rotation axis line L1. With the configuration where the belt holding member 30 is inclined from the positive direction of the first rotation axis line L1 toward the direction B, the belt holding member 30 is easily inserted and removed in/from the heater holding member 40.

As shown in FIG. 10B, when the belt holding member 30 is inserted in the heater holding member 40 in the direction B, the lower surface of the hook portion 36 slides on the upper surface of the inclined guide portion 43.

Subsequently, as shown in FIG. 10C, when the belt holding member 30 is further inserted in the heater holding member 40 in the direction B, the hook portion 36 moves in the direction A and is locked to the recessed portion 41.

According to the present embodiment, the hook portion 36 of the belt holding member 30 is locked to the recessed portion 41 of the heater holding member 40. This makes it difficult for the belt holding member 30 to fall from the heater holding member 40. As a result, the positional relationship between the heater 60 and the sheet S is further stabilized.

In addition, according to the present embodiment, it is possible to easily lock the hook portion 36 of the belt holding member 30 to the recessed portion 41 of the heater holding member 40.

In addition, according to the present embodiment, it is difficult for the hook portion 36 to remove from the recessed portion 41, thereby it is difficult for the belt holding member 30 to remove from the heater holding member 40.

Embodiments of the present disclosure have been described above with reference to the accompanying drawings. However, the present disclosure is not limited to the above-described embodiments, but may be implemented in various manners without departing from the scope of the present disclosure. In the drawings, the components are shown schematically for easy understanding, and the components are drawn as different from the actual ones in thickness, length, number, and so on for the sake of drawing. In addition, the material, shape, measurement and the like of each component are not limited to those described in the present embodiment, but may be varied without departing from the effect of the present disclosure.

The present disclosure is applicable to the fields of the fixing device and the image forming apparatus.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A fixing device comprising:

a fixing belt configured to heat a sheet;

a heater holding member configured to guide the fixing belt such that the fixing belt can peripherally rotate, the heater holding member holding a heater that heats the fixing belt;

a belt holding member that is fixed in position with respect to a conveyance path of the sheet and holds an end portion of the fixing belt in a rotation axis direction of the fixing belt such that the fixing belt can peripherally rotate; and a stay sheet-metal that reinforces the heater holding member, wherein the belt holding member includes an engaging portion, the heater holding member includes an engaged portion that is engaged with the engaging portion to restrict a movement of the belt holding member with respect to the heater holding member, the belt holding member further includes a stay sheet-metal holding portion that holds the stay sheet-metal such that the stay sheet-metal is fastened to the heater holding member, and the engaging portion is disposed in the stay sheet-metal holding portion, and the engaging portion is disposed in the stay sheet-metal holding portion.

2. The fixing device according to claim 1, wherein the engaging portion is a projection portion, and the engaged portion is a recessed portion.

3. The fixing device according to claim 2, wherein the projection portion projects in a direction perpendicular to a rotation axis of the fixing belt, and the recessed portion is recessed in the direction perpendicular to the rotation axis of the fixing belt such that the projection portion is locked to the recessed portion.

4. The fixing device according to claim 1, wherein the engaging portion is a hook portion that extends in the rotation axis direction of the fixing belt and bends in a direction perpendicular to the rotation axis direction.

5. The fixing device according to claim 4, wherein the heater holding member further includes a guide portion that guides the hook portion to the engaged portion.

6. The fixing device according to claim 5, wherein the guide portion is inclined at an acute angle with respect to the direction perpendicular to the rotation axis direction of the fixing belt.

7. An image forming apparatus comprising:

the fixing device according to claim 1; and an image forming portion configured to form a toner image on a sheet.

* * * * *